US010102802B2

(12) United States Patent
Kwon et al.

(10) Patent No.: US 10,102,802 B2
(45) Date of Patent: Oct. 16, 2018

(54) ORGANIC LIGHT-EMITTING DISPLAY DEVICE AND METHOD FOR DRIVING THE SAME

(71) Applicant: LG Display Co., Ltd., Seoul (KR)

(72) Inventors: Yongchul Kwon, Seoul (KR); Dongwon Park, Gyeonggi-do (KR); Jongmin Park, Gyeonggi-do (KR); Joonhee Lee, Seoul (KR)

(73) Assignee: LG Display Co., Ltd., Seoul (KR)

( * ) Notice: Subject to any disclaimer, the term of this patent is extended or adjusted under 35 U.S.C. 154(b) by 0 days.

(21) Appl. No.: 15/393,662

(22) Filed: Dec. 29, 2016

(65) Prior Publication Data

US 2017/0193900 A1 Jul. 6, 2017

(30) Foreign Application Priority Data

Dec. 30, 2015 (KR) ..... 10-2015-0190436
Sep. 29, 2016 (KR) ..... 10-2016-0125627

(51) Int. Cl.

| | |
|---|---|
| ***G09G 5/10*** | (2006.01) |
| ***G09G 3/3233*** | (2016.01) |
| ***G09G 3/3275*** | (2016.01) |
| *G09G 3/3266* | (2016.01) |

(52) U.S. Cl.

CPC ..... *G09G 3/3233* (2013.01); *G09G 3/3275* (2013.01); *G09G 3/3266* (2013.01); *G09G 2310/0289* (2013.01); *G09G 2310/08* (2013.01); *G09G 2320/043* (2013.01); *G09G 2320/0673* (2013.01); *G09G 2330/021* (2013.01)

(58) Field of Classification Search

CPC .. G09G 3/3233; G09G 3/3275; G09G 3/3266; G09G 2310/08; G09G 2310/0289; G09G 2320/043; G09G 2320/0673; G09G 2330/021

USPC .... 345/76–84, 174, 204–211, 589, 690–692; 349/38; 313/506; 257/59

See application file for complete search history.

(56) References Cited

U.S. PATENT DOCUMENTS 7,239,297 B2 * 7/2007 Tajima ..... G09G 5/006 345/690
8,665,295 B2 * 3/2014 Leon ..... G09G 3/3233 345/690
2004/0256617 A1 * 12/2004 Yamada ..... G09G 3/325 257/59

(Continued)

FOREIGN PATENT DOCUMENTS

KR 10-2015-0114065 A 10/2015

*Primary Examiner* — Prabodh M Dharia
(74) *Attorney, Agent, or Firm* — Morgan, Lewis & Bockius LLP

(57) ABSTRACT

An organic light-emitting display device including a display panel, a power supply, a selective driver and a gamma change driver is disclosed. The display panel includes sub-pixels. The power supply is configured to output a drive voltage for driving the sub-pixels. The selective driver is configured to generate a control signal to enable selective drive between first and second driving schemes for a drive transistor in each sub-pixel, wherein the first and second schemes employ saturation and linear regions of the drive voltage curve respectively. The gamma change driver is configured to change a gamma based on the driving scheme selected by the selective driver.

20 Claims, 18 Drawing Sheets

(56) References Cited

U.S. PATENT DOCUMENTS

2006/0214888 A1* 9/2006 Schneider ..... G09G 3/3233 345/76
2007/0018918 A1* 1/2007 Chung ..... G09G 3/3266 345/76
2007/0075638 A1* 4/2007 Shirasaki ..... G09G 3/325 313/506
2007/0132673 A1* 6/2007 Jinno ..... G09G 3/006 345/76
2007/0216616 A1* 9/2007 Stessen ..... G09G 3/3413 345/84
2008/0252653 A1* 10/2008 Alessi ..... G09G 3/3208 345/589
2009/0141202 A1* 6/2009 Yoshida ..... G09G 3/3648 349/38
2013/0300781 A1* 11/2013 Lee ..... G09G 3/3406 345/691
2014/0043316 A1* 2/2014 Chaji ..... G09G 3/3233 345/212
2014/0176489 A1* 6/2014 Park ..... G06F 3/0412 345/174
2016/0027381 A1* 1/2016 Ryu ..... G09G 3/3233 345/76
2016/0078818 A1* 3/2016 Kang ..... G09G 3/3291 345/212
2016/0093258 A1* 3/2016 Ahn ..... G09G 3/3614 345/209
2016/0148564 A1* 5/2016 Kim ..... G09G 3/3233 345/211
2017/0103701 A1* 4/2017 Zhu ..... G09G 3/3233

* cited by examiner

ORGANIC LIGHT-EMITTING DISPLAY DEVICE AND METHOD FOR DRIVING THE SAME

This application claims the benefit of Korean Patent Application No. 10-2015-0190436, filed on Dec. 30, 2015 and No. 10-2016-0125627, filed on Sep. 29, 2016, which is incorporated herein by reference for all purposes as if fully set forth herein.

BACKGROUND

Field of the Invention

The present invention relates to an organic light-emitting display device and a method for driving the same.

Discussion of the Related Art

Along with evolving information technology, display devices have been widely used as a connection medium between a user and information. In this regard, as one type of display device, an organic light-emitting display (OLED) device has been increasingly employed.

The organic light-emitting display device may include a display panel including a plurality of sub-pixels, a driver configured to output a drive signal to drive the display panel, and a power supply to generate power to be supplied to the driver and display panel. The driver may include a scan driver to supply a scan signal or a gate signal to the display panel, and a data driver to supply a data signal to the display panel. When the sub-pixels in the display panel receive drive signals, for example, a scan signal and a data signal, a selected sub-pixel emits a light beam. In this manner, the sub-pixels may display an image.

The organic light-emitting display device may be implemented in a variety of devices, such as a television, a navigation device, a video player, a personal computer, wearable devices including, for example, a watch and glasses, and mobile phones including, for example, a smartphone. There is a need to reduce electric consumption in conventional organic light-emitting display devices.

SUMMARY

Accordingly, the present invention is directed to an organic light-emitting display device and a method for driving the same that substantially obviate one or more problems due to limitations and disadvantages of the related art.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the present invention, as embodied and broadly described herein, a display device comprises: a display panel including at least one data line, at least one gate line, and a sub-pixel connected to the data line and the gate line, the sub-pixel including a drive transistor; a timing controller configured to provide a data signal and a data control signal based on an input image data and one or more timing control signals; a data driver configured to provide a data voltage to the data line based on the data signal and the data control signal; a power supply configured to provide a first high level voltage and a second high level voltage different from the first high level voltage; and a selective driver configured to control a selection between the first high level voltage and the second high level voltage to be supplied to a drain of the drive transistor based on the data signal.

In another aspect of the present invention, a display device comprises: a display panel having at least one data line, at least one gate line, and a sub-pixel connected to the data line and the gate line, the sub-pixel including a drive transistor; a first circuit board including a host system configured to provide an input image data and one or more timing signals, and a power supply configured to provide a first high level voltage and a second high level voltage different from the first high level voltage; a second circuit board including a timing controller configured to provide a data signal and a data control signal based on the input image data and the one or more timing control signals, and a selective driver configured to control a selection between the first high level voltage and the second high level voltage to be supplied to a drain of the drive transistor; and a data driver configured to provide a data voltage to the data line based on the data signal and the data control signal.

In yet another aspect of the present invention, a method of driving a display device comprising a display panel having at least one data line, at least one gate line, and a sub-pixel at an intersection of the data line and the gate line and including a drive transistor is disclosed. The method comprises: receiving an input image data and one or more timing signals; generating a data signal and a data control signal based on the input image data and the one or more timing signals; providing a data voltage to the data line based on the data signal and the data control signal; and selectively supplying a first high level voltage higher than the data voltage and a second high level voltage lower than the data voltage to a drain of the drive transistor based on the data signal.

It is to be understood that both the foregoing general description and the following detailed description of the present invention are exemplary and explanatory, and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

DETAILED DESCRIPTION OF EXAMPLE EMBODIMENTS

Example embodiments of the present invention will now be described in detail with reference to the attached drawings.

An organic light-emitting display device may be implemented, for example, as a top-emission, bottom-emission, or dual-emission type, depending on a light-emission direction therefrom. The organic light-emitting display device may also be implemented, for example, as an inverted staggered, staggered, or coplanar type, depending on a channel structure of a transistor employed. The inverted staggered type may include a back channel etched BCE type or an etch stopper ES type. The organic light-emitting display device may further be implemented, for example, as an oxide, low temperature poly-silicon LTPS, amorphous silicon a-Si, or poly-silicon p-Si type, depending on a semiconductor material of a transistor.

The organic light-emitting display device may be implemented, for example, in a television, a navigation device, a video player, a personal computer, wearable devices, such as watches and glasses, and mobile phones, such as a smartphone.

A First Embodiment

Figure 1:
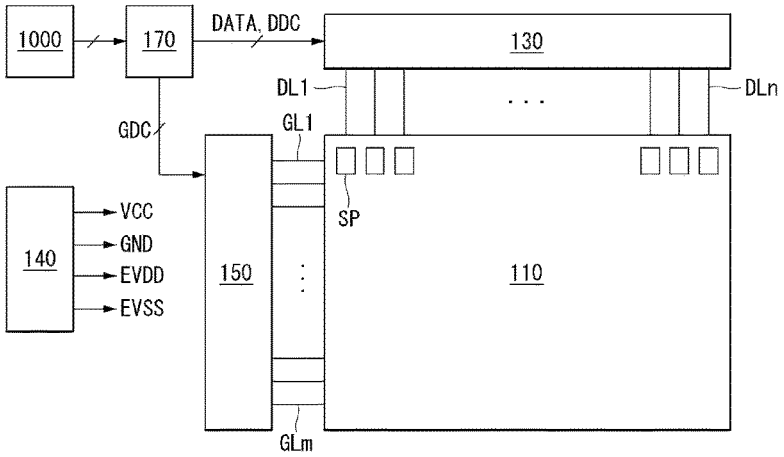
FIG. 1 is a schematic block view of an organic light-emitting display device in accordance with a first embodiment of the present invention.
Figure 2:
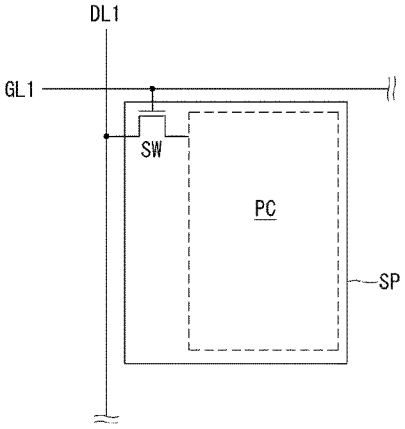
FIG. 2 schematically illustrates a configuration of a sub-pixel in FIG. 1.

FIG. 1 is a schematic block view of an organic light-emitting display device in accordance with a first embodiment of the present invention. FIG. 2 schematically illustrates a configuration of a sub-pixel in FIG. 1. As shown in FIG. 1, the organic light-emitting display device may include a host system 1000, a timing controller 170, a data driver 130, a power supply 140, a gate driver 150, and a display panel 110. The host system 1000 may include a SoC (System on Chip) having a scaler disposed therein. The host system 1000 may convert digital video data of an input video to a data signal in a suitable format for display via the display panel 110 and then output the data signal. The host system 1000 may also supply a variety of timing signals along with the data signal to the timing controller 170.

The timing controller 170 may be configured to control operation timings of the data driver 130 and the gate driver 150 based on the timing signals from the host system 1000. Examples of the timing signals include, without limitation, vertical and horizontal synchronization signals, a data enable signal, and a main clock signal. The timing controller 170 may be configured to perform a video process, such as data compensation, on the data signal from the host system 1000, and then supply the processed or compensated data signal DATA to the data driver 130.

The data driver 130 may be configured to operate based on the data control signal DDC from the timing controller 170. The data driver 130 may be configured to convert the data signal DATA in a digital form from the timing controller 170 to a data signal in an analog form and then output the analog data signal. In this regard, the data driver 130 may be configured to convert the data signal DATA in a digital form to the data signal in an analog form based on gamma voltages from a gamma circuit inside or outside the data driver 130. The data driver 130 may supply the analog data signal to data lines DL1 to DLn of the display panel 110, where n is a positive integer greater than 1.

The gate driver 150 may be configured to operate based on a gate control signal GDC from the timing controller 170. The gate driver 150 may be configured to output a gate signal or a scan signal of a gate high voltage or gate low voltage. The gate driver 150 may be configured to sequentially output the gate signals in a forward or reverse direction. The gate driver 150 may be configured to supply the gate signal to gate lines GL1 to GLm of the display panel 110, where m is a positive integer greater than 1.

The power supply 140 may be configured to output a high level voltage (drain voltage) EVDD and a low level voltage (source voltage) EVSS for driving the display panel 110, and a collector voltage VCC and a ground voltage GND for driving the data driver 130, among other elements. Additionally, the power supply 140 may be configured to generate other voltages used in operating the display device, such as the gate high level voltage or the gate low level voltage to be supplied to the gate driver 150.

The display panel 110 may include the sub-pixels SP, the data lines DL1 to DLn coupled to the sub-pixels SP respectively, and the gate lines GL1 to GLm coupled to the sub-pixels SP respectively. The display panel 110 may be configured to display an image based on the gate signal from the gate driver 150 and the data signal from the data driver 130. The display panel 110 may include lower and upper substrates. The sub-pixels SP may be disposed between the lower and upper substrates.

As shown in FIG. 2, for example, a single sub-pixel SP may include a switching thin film transistor SW coupled to the gate line GL1 and the data line DL1 (or disposed at an intersection thereof), and a pixel circuit PC configured to operate based on the data signal supplied via the switching thin film transistor SW. The pixel circuit PC may include a drive transistor, a storage capacitor, an organic light-emission diode, and a pixel compensation circuit (not shown). The pixel compensation circuit may be configured to compensate at least one of the drive transistor, storage capacitor, and organic light-emission diode.

The pixel compensation circuit may be configured to compensate for characteristics of the drive transistor (for example, a threshold voltage or current mobility, among other things) or characteristics of the organic light-emission diode (for example, a threshold voltage), or for deteriorations in one or both of the drive transistor and the organic light-emission diode. The pixel compensation circuit may operate independently or in association with an external circuit. The pixel compensation circuit may include at least one thin film transistor and a capacitor. The pixel compensation circuit may have varying configurations known in the art, depending on compensation approaches employed. Thus, further details for the configuration of the pixel compensation circuit will be omitted.

Figure 3:
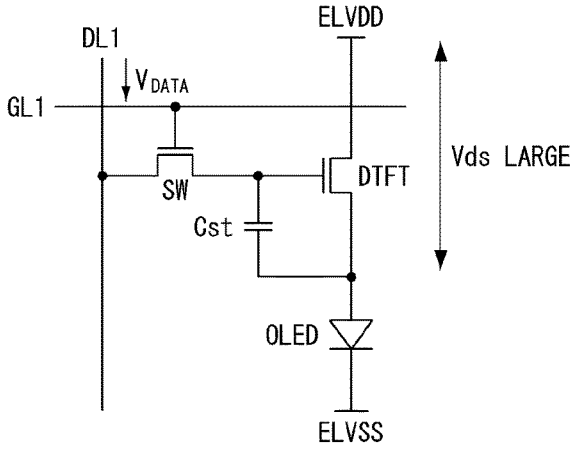
Fig. 3 RELATED ART
FIG. 3 illustrates a circuit configuration of a prior art sub-pixel.
Figure 4:
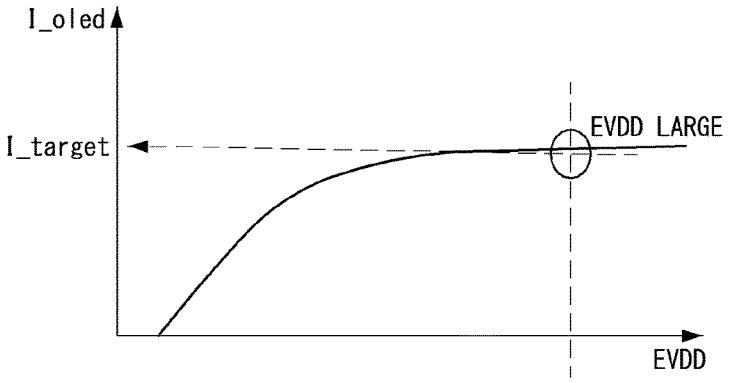
Fig. 4 RELATED ART
FIG. 4 is a graph of a current versus voltage curve of a drive transistor based on a prior art driving method for the prior art sub-pixel.

FIG. 3 illustrates a circuit configuration of a related art sub-pixel. FIG. 4 is a graph of a current versus voltage curve based on a related art driving method for the related art sub-pixel of FIG. 3.

As shown in FIG. 3 and FIG. 4, in the related art driving method, a drive transistor DTFT is driven in a saturation region of the curve to operate the sub-pixel. Thus, a high level drive voltage (that is, a high level Vds and EVDD as shown in FIGS. 3 and 4) was used. In this way, since the related art organic light-emitting display device drives the drive transistor DTFT in the saturation region of the current versus voltage curve, the high level voltage EVDD is used, leading to unnecessarily high power consumption.

Figure 5:
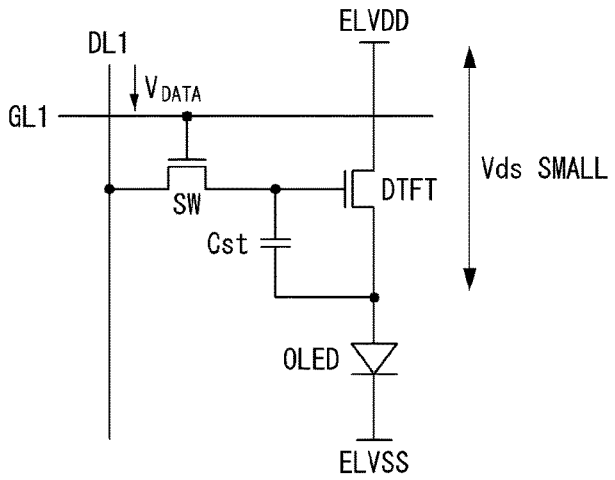
FIG. 5 illustrates a circuit configuration of a sub-pixel in accordance with a first embodiment of the present invention.
Figure 6:
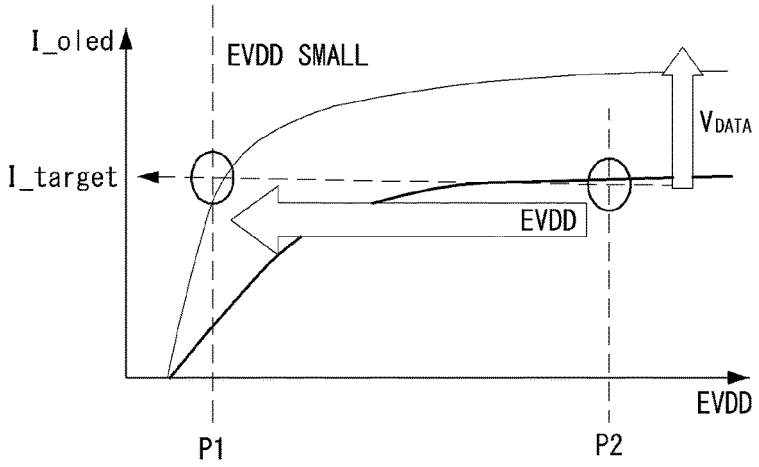
FIG. 6 is a graph of a current versus voltage curve of a drive transistor in accordance with a first embodiment of the present invention.
Figure 7:
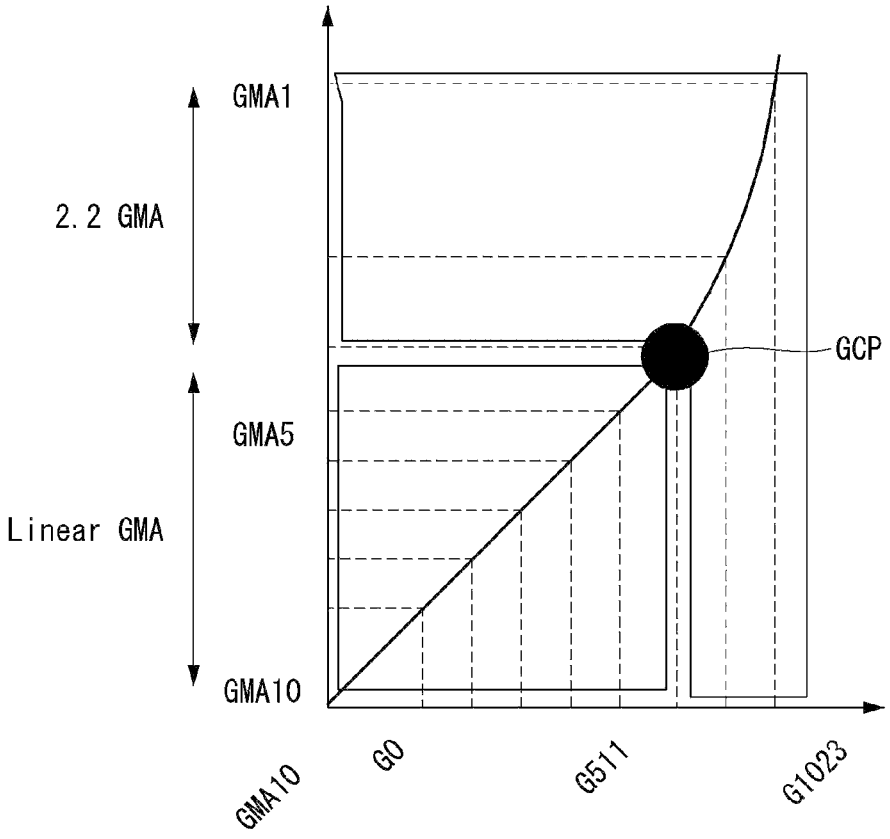
FIG. 7 is a graph of a gamma voltage versus grey-scale curve for describing a grey-scale expression scheme in accordance with a first embodiment of the present invention.
Figure 8:
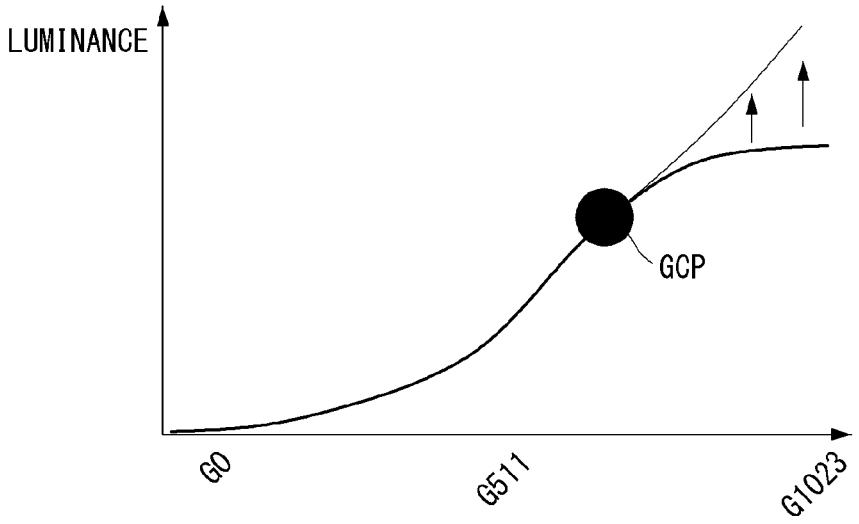
FIG. 8 is a graph of a luminance versus grey-scale curve based on the grey-scale expression scheme in FIG. 7.
Figure 9:
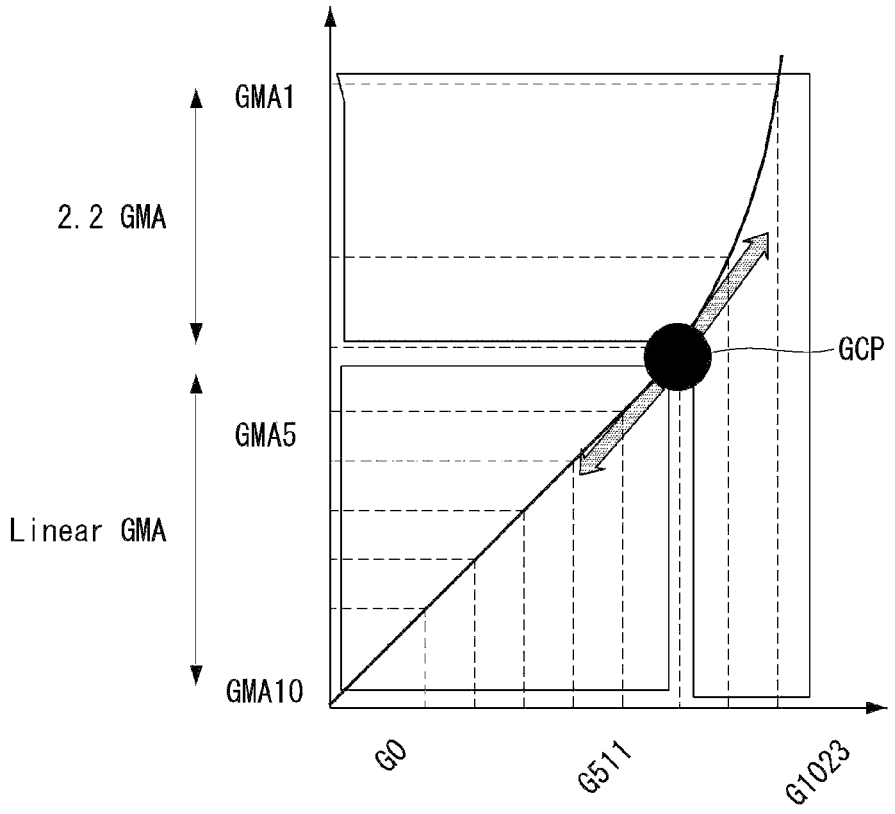
FIG. 9 is a graph of an adaptive gamma curve for grey-scale expression in accordance with a first embodiment of the present invention.
Figure 10:
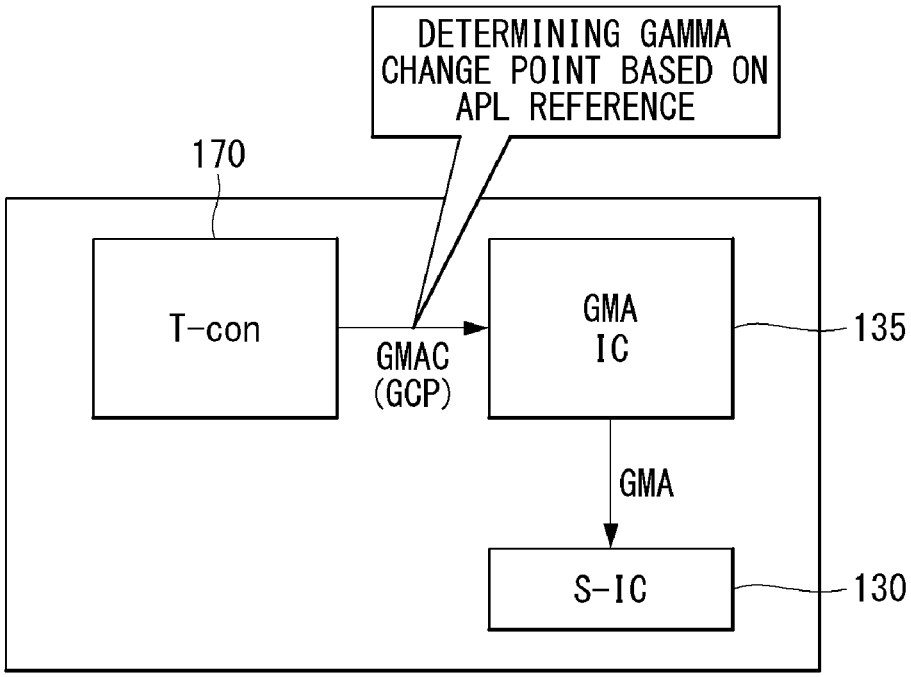
FIG. 10 illustrates an exemplary configuration of a device in accordance with a first embodiment of the present invention.
Figure 11:
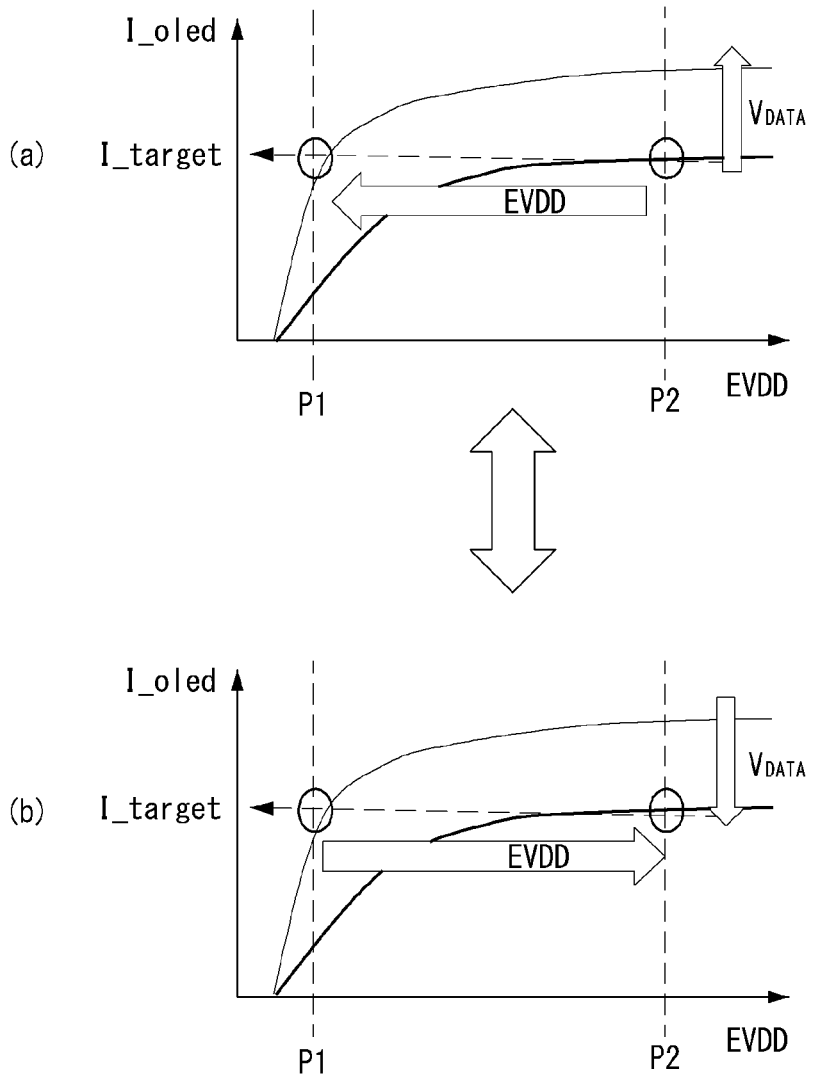
FIG. 11 show graphs of current versus voltage curves for a drive transistor for describing a driving method of an organic light-emitting display device in accordance with a first embodiment of the present invention.

FIG. 5 illustrates a circuit configuration of a sub-pixel in accordance with a first embodiment of the present invention. FIG. 6 is a graph of a current versus voltage curve of a drive transistor in accordance with a first embodiment of the present invention. FIG. 7 is a graph of a gamma voltage versus grey-scale curve for describing a grey-scale expression scheme in accordance with a first embodiment of the present invention. FIG. 8 is a graph of a luminance versus grey-scale curve based on the grey-scale expression scheme in FIG. 7. FIG. 9 is a graph of an adaptive gamma curve for grey-scale expression in accordance with a first embodiment of the present invention. FIG. 10 illustrates an exemplary configuration of a device in accordance with a first embodiment of the present invention. FIG. 11 show graphs of current versus voltage curves for a drive transistor for describing a driving method of an organic light-emitting display device in accordance with a first embodiment of the present invention.

As shown in FIG. 5 and FIG. 6, in accordance with a first embodiment of the present invention, to reduce power consumption by the organic light-emitting display device, the drive transistor DTFT in the sub-pixel may be driven using a combination of the saturation region and the linear region of the current versus voltage curve. Further, to reduce power consumption by the organic light-emitting display device, a level of the high level voltage EVDD may be shifted to a lower level than the data voltage $V_{DATA}$ forming the data signal.

For example, in accordance with a first embodiment of the present invention, when the drive transistor DTFT generates a current I_oled for driving the organic light-emission diode OLED, the high level voltage EVDD, which is one of the parameters for generating a target current I_target, may be lowered from P2 to P1.

When the drive transistor DTFT in the sub-pixel is driven in the linear region of the curve, the high level voltage EVDD may be set at a lower level compared to the related art method, reducing a stress on the transistor compared to the related art method. As a result, deterioration of the transistor may be delayed for a longer time period than in the related art method where the drive transistor is driven in the saturation region.

FIG. 5 illustrates, by way of example, a 2T1C configuration where two transistors SW and DTFT and a single capacitor Cst are used to drive the organic light-emission diode OLED. However, the present invention is not limited to such a configuration. Rather, the present invention is applicable to the organic light-emitting display devices with sub-pixels employing any of various pixel circuit configurations.

As shown in FIG. 7 and FIG. 8, the driving method in accordance with a first embodiment of the present invention may employ a linear gamma (Linear GMA) to express low and middle range grey-scales and a non-linear gamma (for example, 2.2 GMA) to express high range grey-scales. This is because when an actual pixel is used to express the grey-scales, the drive transistor DTFT may be driven in the saturation region to express the low and middle range grey-scales and in the linear region to express the high range grey-scales. To this end, the driving method in accordance with a first embodiment of the present invention may employ an adaptive gamma curve including an algorithm for determining a gamma change point (GCP). With the adaptive gamma curve, the GCP may be changed in an adaptive manner.

If the gamma is varied along the adaptive gamma curve, the data voltage may be raised without a separate mechanism when the transistor is driven in the linear region drive. If the adaptive gamma curve is employed, the gamma curve may vary in accordance with the low, middle, and high grey-scale ranges.

As shown in FIG. 9, the gamma change point (GCP) may be determined based on the data voltage level. The data voltage level for expressing the same grey-scale may vary. This is, for example, because a peak data voltage level may vary based on an average picture level (APL) according to a peak luminance control (PLC) algorithm.

Since the data voltage level may be different even for the same grey-scale, the gamma change point (GCP) may be determined based on the peak luminance control (PLC) or the average picture level (APL) reference. As a result, the gamma change point (GCP) may shift down to the linear region or up to the non-linear region based on the data voltage level.

As shown in FIG. 9 and FIG. 10, the gamma change point (GCP) may vary based on characteristics of the data voltage level. Thus, to reflect variations in the characteristics of the data voltage level, the organic light-emitting display device may be configured such that the gamma change point (GCP) at a gamma circuit (GMA IC) 135 may be controlled based on a gamma change signal GMAC from the timing controller (T-con) 170. In this regard, a module or system for changing a driving scheme for the drive transistor may be contained in the timing controller 170. However, the present invention is not limited thereto. The module or system for changing the driving scheme for the drive transistor may be formed as a separate circuit, in which case the gamma change signal GMAC may be supplied from the separate circuit.

As shown in FIG. 11, in a method for driving the organic light-emitting display device in accordance with a first embodiment of the present invention, to avoid image quality deterioration resulting from the driving of the drive transistor in the linear region, the driving scheme may be changed for an image data anticipated to have such image quality deterioration.

For example, when an image data which is not expected to have such image quality deterioration is input, a driving scheme is carried out as shown in FIG. 11(*a*). That is, the drive transistor is driven in the linear region, and the level of the high level voltage EVDD is shifted to a level lower than the level of the data voltage $V_{DATA}$. On the other hand, when an image data which is expected to have such image quality deterioration is input, a driving scheme is carried out as shown in FIG. 11(*b*). That is, the drive transistor is driven in the saturation region, and the level of the high level voltage EVDD is shifted to a level higher than the level of the data voltage $V_{DATA}$. In this regard, to switch the driving schemes of the drive transistor based on whether such image quality deterioration is anticipated for a certain image data, the OLED device may be configured, for example, as discussed below.

Figure 12:
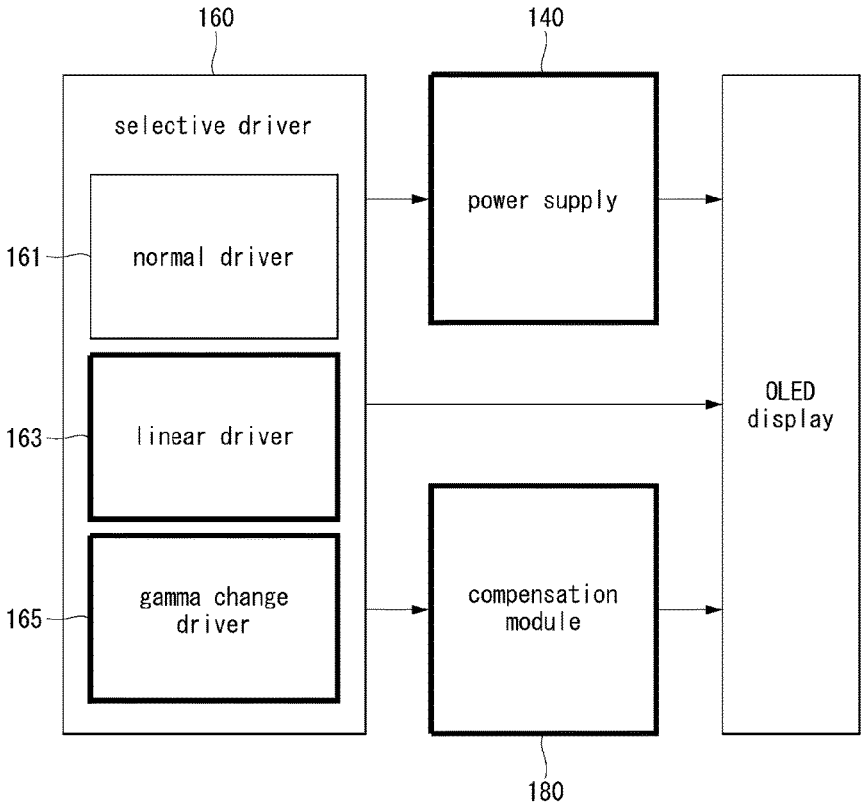
FIG. 12 shows a block diagram of components of interest of an organic light-emitting display device in accordance with a first embodiment of the present invention.
Figure 13:
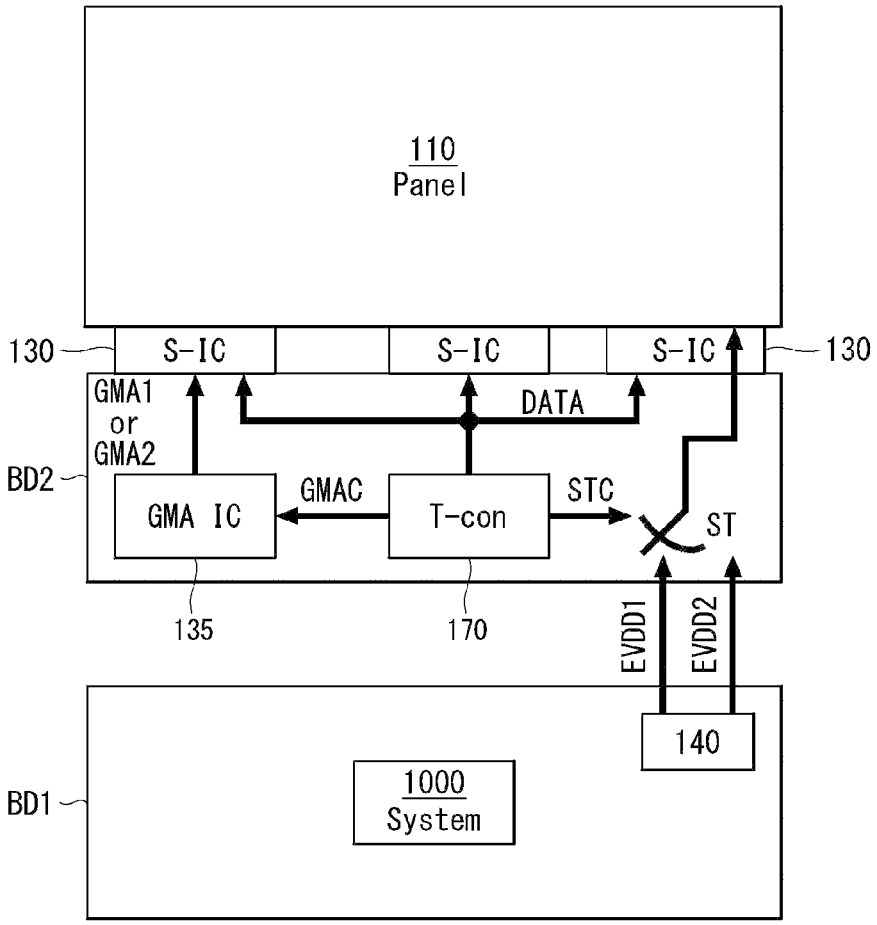
FIG. 13 shows a modular configuration in accordance with a first example of the present invention.
Figure 14:
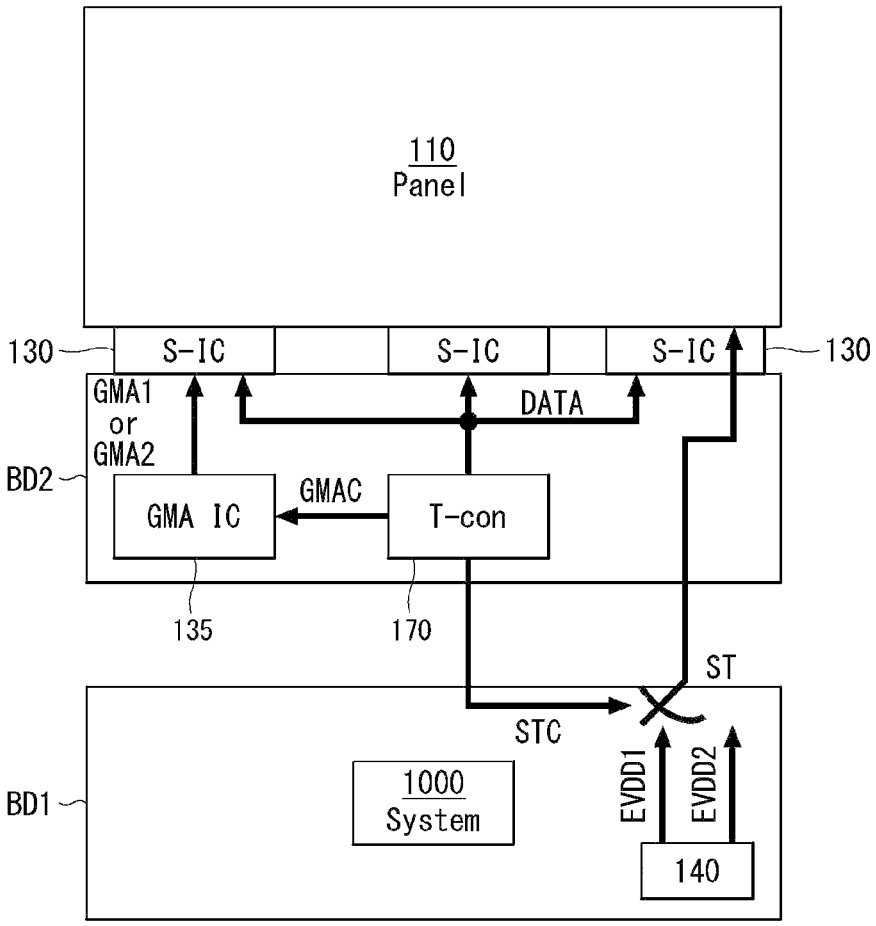
FIG. 14 shows a modular configuration in accordance with a second example of the present invention.

FIG. 12 shows a block diagram of components of interest of an organic light-emitting display device in accordance with a first embodiment of the present invention. FIG. 13 shows a modular configuration in accordance with a first example of the present invention. FIG. 14 shows a modular configuration in accordance with a second example of the present invention.

As shown in FIG. 12, the organic light-emitting display device in accordance with a first embodiment of the present invention may include a selective driver 160, a power supply 140, and a compensation circuit 180. The selective driver 160 and compensation circuit 180 may be integrated into a single module, for example, into the timing controller.

The selective driver 160 may be configured to enable selective driving of the drive transistor in the sub-pixel between the first and the second driving schemes. In the first driving scheme, for example, the drive transistor in the sub-pixel in the display panel may be driven in the saturation region ($EVDD>V_{DATA}$). In the second driving scheme, for example, the drive transistor in the sub-pixel in the display panel may be driven in the linear region ($EVDD<V_{DATA}$). For enabling such selective driving, the selective driver 160 may include a non-linear driver (or normal driver) 161, a linear driver 163, and a gamma change driver 165.

The non-linear driver 161 may be configured to create a first drive control signal to instruct the first driving scheme to be carried out. That is, using the first drive control signal, the drive transistor in the sub-pixel in the display panel may be driven in the saturation or non-linear region. In this regard, when the non-linear driver 161 outputs the first drive control signal to the power supply 140, the power supply 140 may be configured to shift the level of the high level voltage EVDD to a level higher than the level of the data voltage $V_{DATA}$.

The linear driver 163 may be configured to create a second drive control signal to instruct the second driving scheme to be carried out. That is, using the second drive control signal, the drive transistor in the sub-pixel in the display panel may be driven in the linear or non-separation region. In this regard, when the linear driver 163 outputs the second drive control signal to the power supply 140, the power supply 140 may be configured to shift the level of the high level voltage EVDD to a level lower than the level of the data voltage $V_{DATA}$.

The linear driver 163 may force the drive transistor in the sub-pixel in the display panel to be driven in the saturation region when an image data with expected image quality deterioration is input. In other words, even if the driving scheme is set to the second driving scheme for the linear driver 163, the linear driver 163 may force performing the first driving scheme using the saturation region, not the second driving scheme using the linear region, when an image data with expected image quality deterioration is input. To this end, the linear driver 163 may be configured to reference a lookup table including as parameters one or more factors for predicting or forecasting image quality deterioration. The lookup table may be stored in a memory as data. Alternatively, the linear driver 163 may be configured to predict the image quality deterioration using an image analysis algorithm.

The factors for predicting or forecasting the image quality deterioration may include, but are not limited to, an average picture level (APL), a total current flowing in the organic light-emission diode (total EL current), a peak value of the grey-scale, an image complexity, a drive frequency, a cross-talk pattern, and so on. These factors may be provided as parametric threshold values through experiments.

The linear driver 163 may be configured to compare parameter values of the current image data with the parametric threshold values in the lookup table and to enable the drive transistor to be driven in the saturation region, for example, when the parameter value(s) of the current image data is or are determined to be smaller than the respective parametric threshold value(s).

For example, upon determination that the image quality deterioration is expected to occur, the linear driver 163 may operate together with the non-linear driver 161 such that the first drive control signal from the non-linear driver 161 is changed to a logic high, instead of the second drive control signal from the linear driver 163 being changed to a logic low.

The gamma change driver 165 may be configured to set the gamma based on characteristics parameters and in accordance with a predetermined condition for the present OLED device. The gamma change driver 165 may be configured to output the gamma change signal indicating the gamma change point at the gamma circuit based on a change in the driving schemes. The gamma change driver 165 may be configured to output the gamma change signal based on the characteristics parameters such as the peak luminance control (PLC) and/or average picture level (APL).

The compensation module or circuit 180 may be configured to analyze the data signal to be inputted to the display panel, and to compensate for the display panel characteristics variation resulting from the selective driving between the first and the second driving schemes respectively using the saturation region and the linear region. Further, the compensation module or circuit 180 may be configured to compensate for the display panel characteristics variation resulting from a change in the gamma change point.

Further, the compensation module 180 may be configured to calculate the display panel characteristics variation, for example, an IR drop resulting from the driving in the linear region and then to compensate for the variation. To this end, the compensation module 180 may be configured to generate and output a compensation signal for compensating for the display panel characteristics variation based on an analysis of the data signal and the gamma change signal from the gamma change driver 165.

In accordance with this example embodiment of the present invention, the power consumption of the OLED device may be reduced while the deterioration of the drive transistor may be delayed or mitigated via the selective driving scheme based on the image quality deterioration estimation. To that end, a drive control signal may be generated to enable selective driving between the first and the second driving schemes for the drive transistor in the sub-pixel, where the first and the second schemes respectively employ the saturation and the linear regions of the drive voltage curve for the drive transistor. Then, based on the selected driving scheme, a gamma change signal may be generated to change the gamma based on the selected driving scheme, and/or the level of a high level voltage (e.g., EVDD) to be supplied to the sub-pixel may be changed.

Hereinafter, an example modular configuration of an organic light-emitting display device will be described where the selective driver 160 and compensation module 180 are incorporated into the timing controller 170.

As shown in FIG. 13 illustrating a first example modular configuration of the organic light-emitting display device, the organic light-emitting display device may be configured with a first circuit board BD1, a second circuit board BD2 and a display panel 110. The first circuit board BD1 may have a host system 1000 and a power supply 140 disposed thereon. The second circuit board BD2 may have the timing controller 170, the gamma circuit 135, and a voltage switching circuit ST disposed thereon. The voltage switching circuit ST may be disposed on the second circuit Board BD2 outside the power supply 140, as shown in FIG. 13, or alternatively inside the power supply 140 disposed on the first circuit board BD1.

As shown in FIG. 14 illustrating a second example modular configuration of the organic light-emitting display device, the organic light-emitting display device may be configured with the first circuit board BD1, the second circuit board BD2, and the display panel 110. The first circuit board BD1 may have the host system 1000, the power supply 140 and the voltage switching circuit ST disposed thereon. The second circuit board BD2 may have the timing controller 170 and the gamma circuit 135 disposed thereon. The voltage switching circuit ST may be disposed inside or outside the power supply 140.

The timing controller 170 may be configured to output a switch control signal STC to selectively supply the first high level voltage EVDD1 or the second high level voltage EVDD2 from the power supply 140 disposed on the first circuit board BD1 to the display panel 110. In one example, the first high level voltage EVDD1 (a saturation region drive voltage) may be higher than the second high level voltage EVDD2 (a linear region drive voltage).

The timing controller 170 may be configured to generate a first switch control signal when the first drive control signal is generated by the non-linear driver disposed therein to drive the drive transistor in the saturation region, that is, the non-linear region.

Further, the timing controller 170 may be configured to output a gamma change signal GMAC when there is a need for a gamma change. For example, the gamma circuit 135 may be configured to supply a gamma voltage GMA1 complying with a first gamma curve to the data driver 130 based on the gamma change signal GMAC.

When the timing controller 170 has outputted the first drive control signal and the first switch control signal, the voltage switching circuit ST may be configured to select the first high level voltage EVDD1 from the power supply 140 to be supplied to the display panel 110. In this way, the display panel 110 may operate based on an operating condition of the saturation region.

The timing controller 170 may be configured to generate a second switch control signal when the second drive control signal is generated by the linear driver disposed therein to drive the drive transistor in the linear region, that is, the region of a condition to change operation.

Further, the timing controller 170 may be configured to output a gamma change signal GMAC when there is a need for a gamma change. For example, the gamma circuit 135 may be configured to supply a gamma voltage GMA2 complying with a second gamma curve to the data driver 130 based on the gamma change signal GMAC.

When the timing controller 170 has outputted the second drive control signal and the second switch control signal, the voltage switching circuit ST may be configured to select the second high level voltage EVDD2 from the power supply 140 to be supplied to the display panel 110. In this way, the display panel 110 may operate based on an operating condition of the linear region.

As described above, in accordance with example embodiments of the present invention, to change the level of the high level voltage, the voltage switching circuit ST may receive the first and the second high level voltages EVDD1 and EVDD2 from the first circuit board BD1 having the host system 1000 and the power supply 140, and select one of the two high level voltages EVDD1 and EVDD2 based on the computing result (parameter computing result) by the timing controller 170, as illustrated in FIG. 13. Alternatively, the voltage switching circuit ST may receive as a feedback the computing result by the timing controller 170 and select one of the two high level voltages EVDD1 and EVDD2 based on the feedback, as illustrated in FIG. 14. These two approaches are merely examples. As another alternative, for example, the power supply 140 and timing controller 170 both may be disposed on the second circuit board BD2. The present invention is not limited to the above example configurations.

A Second Embodiment

Figure 15:
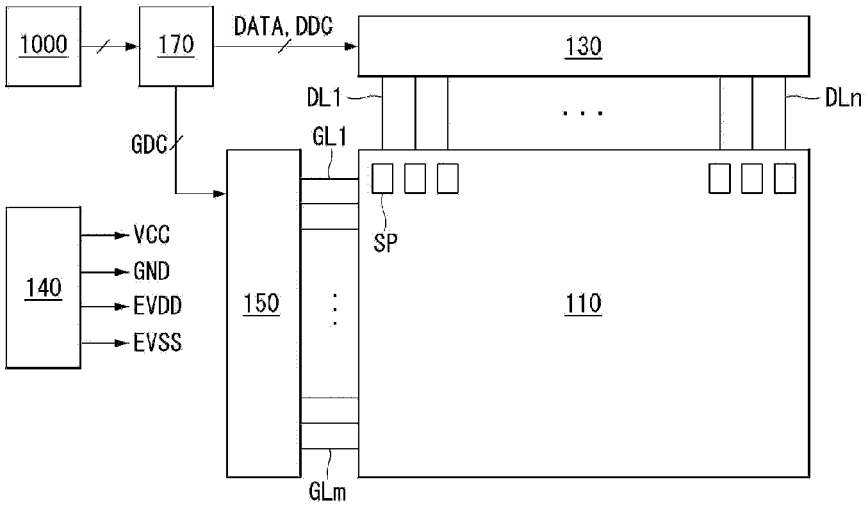
FIG. 15 is a schematic block view of an organic light-emitting display device in accordance with a second embodiment of the present invention.
Figure 16:
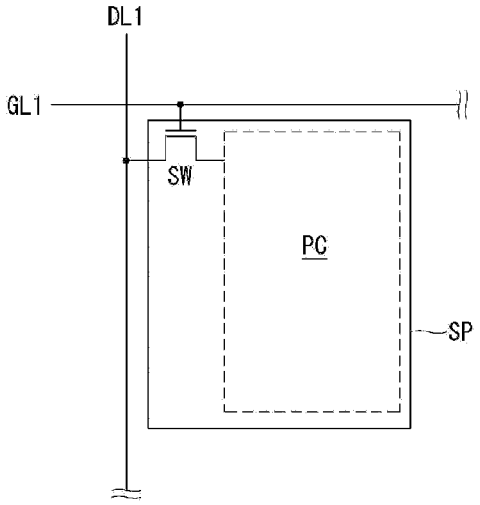
FIG. 16 schematically illustrates a configuration of a sub-pixel in FIG. 15.

FIG. 15 is a schematic block view of an organic light-emitting display device in accordance with a second embodiment of the present invention, and FIG. 16 schematically illustrates a configuration of a sub-pixel in FIG. 15.

As shown in FIG. 15, the organic light-emitting display device may include a host system 1000, a timing controller 170, a data driver 130, a power supply 140, a gate driver 150, and a display panel 110.

The host system 1000 may include a SoC (System on Chip) having a scaler disposed therein, and may convert digital video data of an input video to a data signal with a suitable format for display via the display panel 110, and then output the converted data signal. The host system 1000 may supply a variety of timing signals along with the data signal to the timing controller 170.

The timing controller 170 may be configured to control operation timings of the data driver 130 and gate driver 150 based on timing signals from the host system 1000, such as based on vertical and horizontal synchronization signals, a data enable signal, a main clock signal, etc. The timing controller 170 may be configured to perform video-process, data-compensation, etc for the data signal from the host system 1000, and then supply processed and compensated data signal to the data driver 130.

The data driver 130 may be configured to operate based on the data control signal DDC, etc. from the timing controller 170. The data driver 130 may be configured to convert a data signal DATA in a digital form from the timing controller 170 to a data signal in an analogue form and then output the converted signal.

In this connection, the data driver 130 may be configured to convert the data signal DATA in a digital form to the data signal in an analogue form based on gamma voltages from a gamma module inside or outside the data driver 130. The data driver 130 may supply the data signal to data lines DL1 to DLn of the display panel 110.

The gate driver 150 may be configured to operate based on a gate control signal GDC from the timing controller 170. The gate driver 150 may be configured to output a gate signal or scan signal of a gate high voltage or gate low voltage.

The gate driver 150 may be configured to sequentially output the gate signals in forward or reverse directions. The gate driver 150 may be configured to supply the gate signal to gate lines GL1 to GLm of the display panel 110.

The power supply 140 may be configured to output a high level voltage (drain voltage) EVDD and a low level voltage (source voltage) EVSS for driving the display panel 110, and a collector voltage VCC and a ground voltage GND for driving the data driver 130, etc. Additionally, the power supply 140 may be configured to generate voltages required for operations of the display device, such as the gate high level voltage or gate low level voltage to be delivered to the gate driver 150.

The display panel 110 may include the sub-pixels SP, the data lines DL1 to DLn coupled to the sub-pixels SP respectively, and the gate lines GL1 to GLm coupled to the sub-pixels SP respectively. The display panel 110 may be configured to display an image based on the gate signal from the gate driver 150 and the data signal DATA from the data driver 130. The display panel 110 may include lower and upper substrates. The sub-pixels SP may be disposed between the lower and upper substrates As shown in FIG. 16, a single sub-pixel includes a switching thin film transistor SW coupled to the gate line GL1 and data line DL1 (or disposed at an intersection therebetween), and a pixel circuit PC configured to operate based on the data signal DATA supplied via the switching thin film transistor SW. The pixel circuit PC may include a drive transistor, a storage capacitor, an organic light-emission diode, and a pixel compensation circuit. The pixel compensation circuit may be configured to compensate at least one of the drive transistor, storage capacitor, and organic light-emission diode.

The pixel compensation circuit may be configured to compensate for characteristics of the drive transistor (for example, a threshold voltage, current mobility, etc.), and/or characteristics of the organic light-emission diode (for example, a threshold voltage) and/or for deteriorations thereof. The pixel compensation circuit may operate independently or in association with an external circuit. The pixel compensation circuit may include at least one thin film transistor and capacitor. The pixel compensation circuit may have varying configurations depending on compensation approaches. Thus, further details for the configuration thereof will be omitted.

Figure 17:
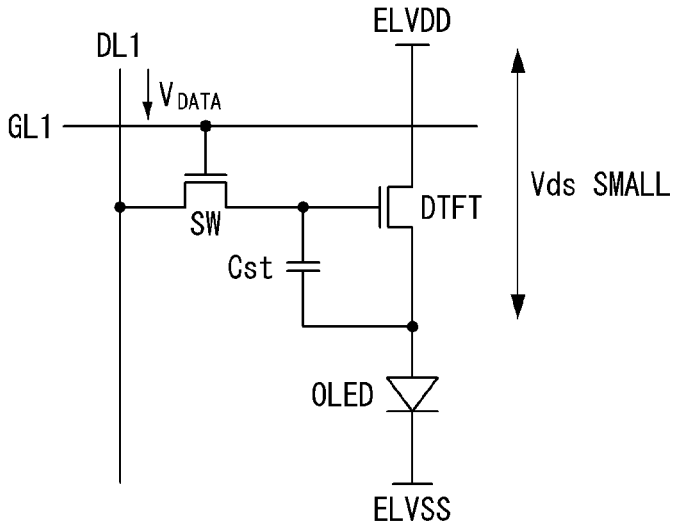
FIG. 17 illustrates a circuit configuration of a sub-pixel in accordance with a second embodiment of the present invention.
Figure 18:
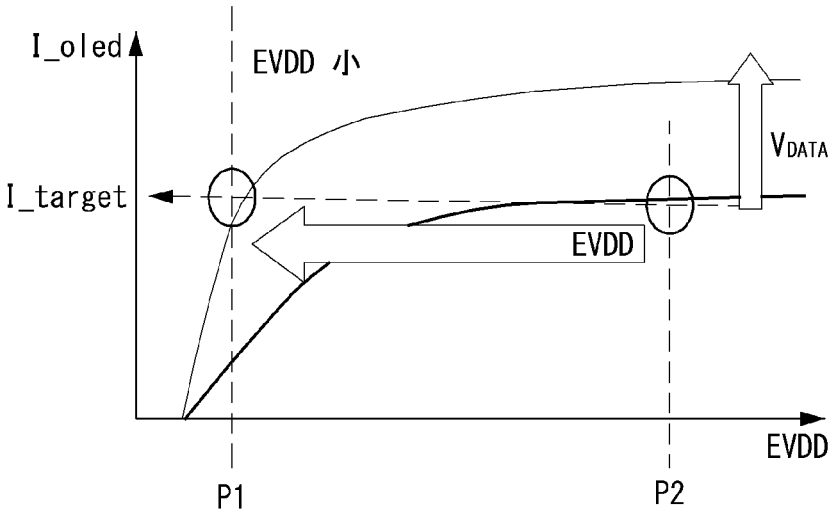
FIG. 18 is a graph of a current versus voltage curve of a drive transistor in accordance with a second embodiment of the present invention.
Figure 19:
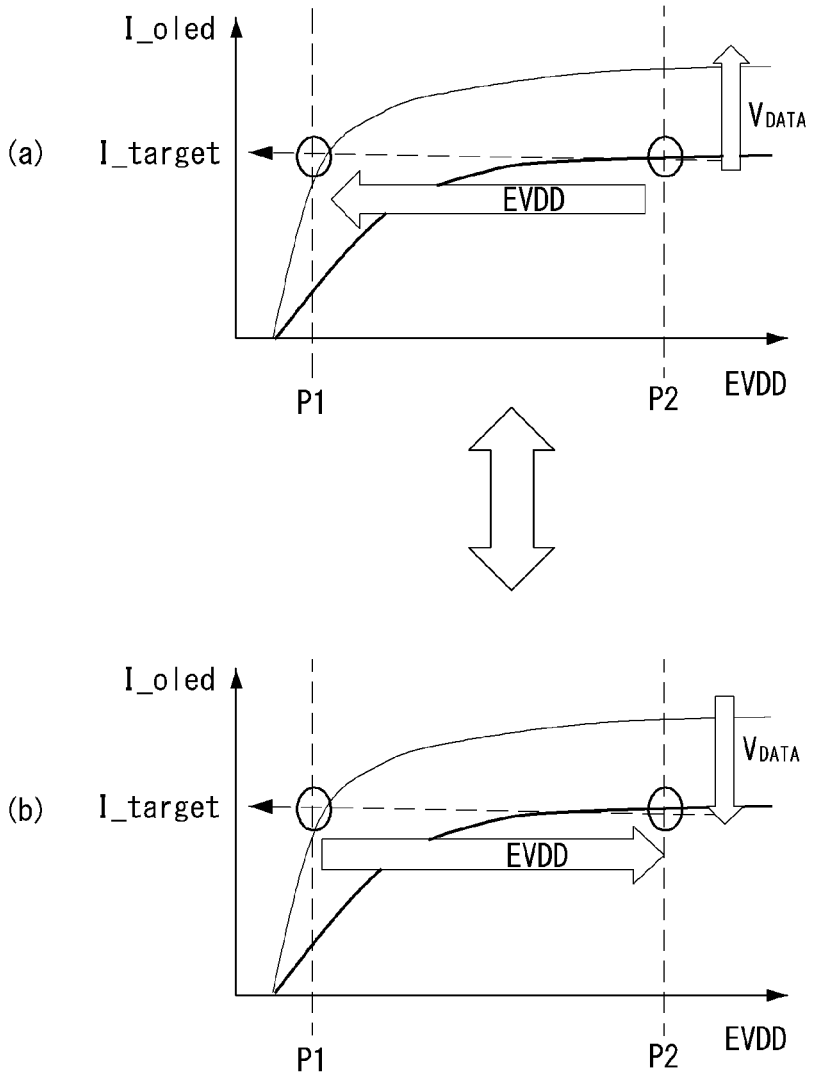
FIG. 19 is a graph of a voltage versus grey-scale curve of a drive transistor for describing a driving method of an organic light-emitting display device in accordance with a second embodiment of the present invention.
Figure 20:
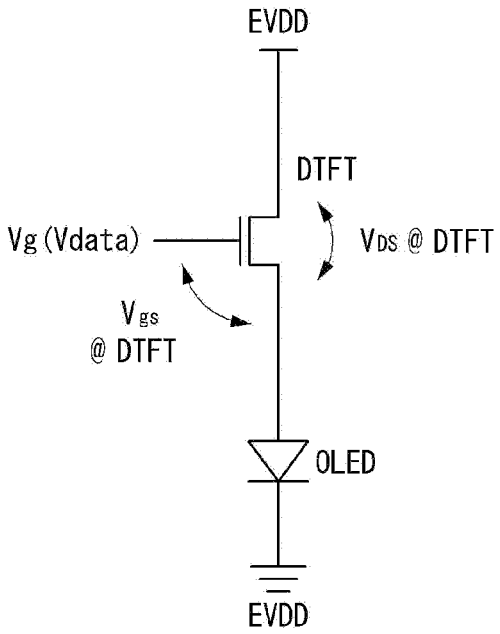
FIG. 20 describes a problem of deterioration of a drive transistor.
Figure 21:
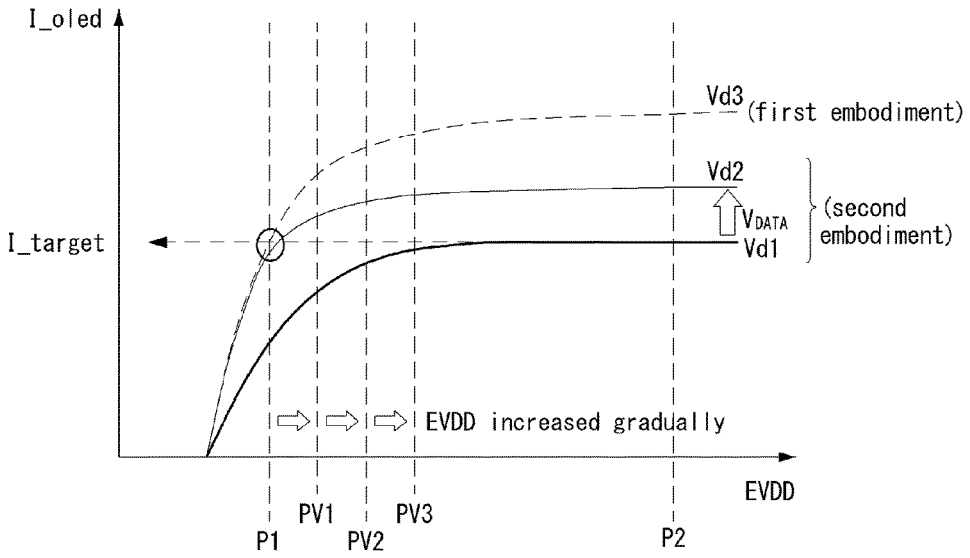
FIG. 21 show graphs of current versus voltage curves for a drive transistor for describing a high level voltage varying scheme in accordance with a second embodiment of the present invention.

FIG. 17 illustrates a circuit configuration of a sub-pixel in accordance with a second embodiment of the present invention, FIG. 18 is a graph of a current versus voltage curve of a drive transistor in accordance with a second embodiment of the present invention, FIG. 19 is a graph of a voltage versus grey-scale curve of a drive transistor for describing a driving method of an organic light-emitting display device in accordance with a second embodiment of the present invention, FIG. 20 describes a problem of deterioration of a drive transistor, and FIG. 21 show graphs of current versus voltage curves for a drive transistor for describing a high level voltage varying scheme in accordance with a second embodiment of the present invention.

As shown in FIG. 17 and FIG. 18, in accordance with a second embodiment of the present invention, in order to achieve power consumption reduction for the organic light-emitting display device, the drive transistor DTFT in the sub-pixel may be driven using a combination of the saturation region and linear region of the current versus voltage curve.

Further, in order to achieve power consumption reduction for the organic light-emitting display device, a level of the high level voltage EVDD may be shifted to a level lower than a level of the data voltage VDATA forming the data signal.

For example, in accordance with a second embodiment of the present invention, when the drive transistor generates a current I_oled for driving the organic light-emission diode, a level of the high level voltage EVDD as one parameter for creating a target current I_target may be lowered from a P2 level to a P1 level.

When the drive transistor DTFT in the sub-pixel is driven using the linear region of the curve, the level of the high level voltage EVDD may be lowered compared to the prior art method. Thus, a stress level undergone by the transistor may be reduced compared to the prior art method. As a result, deterioration of the transistor may be expected to be delayed by a longer time period than in the prior art method where the drive transistor is driven using the saturation region.

FIG. 17 illustrates, by way of example, a generally-employed 2T1C configuration where two transistors SW and DTFT and a single capacitor Cst are used to drive the organic light-emission diode (OLED). However, the present invention is not limited thereto. Rather, the present invention may be applicable to the organic light-emitting display device with the sub-pixel including another various pixel circuit configurations.

The driving method in accordance with a second embodiment of the present invention, as in a first embodiment of the present invention, may employ a linear gamma Linear GMA for expression of low and middle range grey-scales, and employ a non-linear gamma (for example, 2.2 GMA) for expression of a high grey-scale range. This is because when expressing the grey-scale using the actual pixel, the drive transistor is driven using the saturation region for the expression of the low and middle range grey-scales, and using the linear region for the expression of the high grey-scale range.

As shown in FIG. 19, in a method for driving the organic light-emitting display device in accordance with a second embodiment of the present invention, in order to avoid image quality deterioration resulting from the driving of the drive transistor using the linear region, an image data which is expected to have such image quality deterioration may be subjected to a different driving scheme.

For example, when an image data which is not expected to have such image quality deterioration is input, a driving scheme is carried out as shown in FIG. 19(*a*). That is, the drive transistor is driven using the linear region, and the level of the high level voltage EVDD is shifted to a level lower than the level of the data voltage VDATA.

To the contrary, when an image data which is expected to have such image quality deterioration is input, a driving scheme is carried out as shown in FIG. 19(*b*). That is, the drive transistor is driven using the separation region, and the level of the high level voltage EVDD is shifted to a level higher than the level of the data voltage VDATA.

However, as can be seen in FIG. 19(*a*), it is necessary to increase the data voltage VDATA to satisfy a target current I_target when the drive transistor is driven using the linear region. As such, an example of the timing in which the data voltage VDATA to satisfy a target current I_target should be increased may by explained as follows:

As shown in FIG. 20, when the driving time of the drive transistor DTFT is continued or the positive voltage of the drive transistor DTFT is applied continuously, the threshold voltage Vth is shifted in a positive direction due to the image quality deterioration. In this case, a Vgs (or Vgs-Vth) of the drive transistor DTFT is lowered gradually, so the data voltage VDATA should be further increased to satisfy a target current I_target.

Therefore, when the threshold voltage of the drive transistor DTFT is shifted in a positive direction due to the image quality deterioration, the data voltage VDATA should be further increased, however, in this case, the constraints may arise due to the limited output range of the data driver. That is to say, it is difficult to cope with such a problem such as a situation where the data driver cannot increase the data voltage VDATA beyond a constant range due to the limited output range.

Additionally, if a problem such as image quality deterioration is caused continuously, the deterioration deviation of the threshold voltage is scattered on a basis of position or sub-pixel of the display panel resulting in the increased screen stain on the display panel and the decreased lifetime of the display panel. According to the experiment result, this problem may appear more serious when the drive transistor is driven using the linear region, therefore, in accordance with a second embodiment of the present invention, it may be improved as follows:

As shown in FIG. 21, when an image data which is not expected to have such image quality deterioration is input, a driving transistor is driven using the linear region, a level of the high level voltage EVDD may be shifted to a level lower than a level of the data voltage VDATA. At the same time, it may maintain the target current I_target by avoiding the increase in a data voltage VDATA and gradually increasing a level of the high level voltage EVDD according to the deterioration characteristic of the drive transistor.

That is, in accordance with a second embodiment of the present invention, the drive transistor is driven using the linear region, the deterioration characteristic of the drive transistor, for example, threshold voltage is monitored or sensed. Further, when the deterioration characteristic of the drive transistor, for example, threshold voltage deviates from a reference range (for example, a reference threshold voltage) set inside the timing controller 170, the increase in a data voltage VDATA is avoided and a level of the high level voltage EVDD is increased gradually.

To facilitate understanding of the descriptions, the comparison the first embodiment with the second embodiment may be described as follows:

In the first embodiment, in order to drive the drive transistor using the linear region and generate the target current I_target, a level of the high level voltage EVDD is lowered from P2 level to P1 level, and the data voltage VDATA is increased to Vd3.

In the second embodiment, in order to drive the drive transistor using the linear region and generate the target current I_target, a level of the high level voltage EVDD is lowered from P2 level to P1 level, and the data voltage VDATA is maintained in the previous level such as Vd1, or increased to Vd2 by a small amount. Further, in the second embodiment, the deterioration characteristic of the drive transistor, for example, threshold voltage is monitored or sensed, and in response to changes in the deterioration characteristic of the drive transistor, for example, the threshold voltage, the levels PV1, PV2, PV3 of the high level voltage EVDD are increased gradually.

The levels PV1, PV2, PV3 of the high level voltage EVDD are increased gradually, for example, in a P2 direction in proportion to the changes in the threshold voltage. As such, in the second embodiment, the levels PV1, PV2, PV3 of the high level voltage EVDD are also shifted take account of the deterioration characteristic and the compensation margin of the drive transistor. At this time, since the gradually shifted high level voltage EVDD is provided all of sub-pixels commonly, it cannot expect a global compensation effect.

As explained above, it is difficult to obtain a margin that can satisfy a target current I_target only by increasing a data voltage VDATA, when the threshold voltage of the drive transistor DTFT is shifted in a positive direction beyond a constant value, for example, a reference threshold voltage set by the experiment. However, in accordance with a second embodiment of the present invention, a margin being capable of satisfying a target current I_target is obtained, since it is possible to perform an additional compensation only from the data voltage VDATA, when the levels PV1, PV2, PV3 of the high level voltage EVDD are shifted in response to changes in the threshold voltage of the drive transistor.

Accordingly, in accordance with the second embodiment of the present invention, it is possible to secure a compensation range (for example, an output range that is necessary to compensate for the data voltage) in a larger width compared to the first embodiment, since the margin that is capable of shifting the data voltage VDATA is increased.

Figure 22:
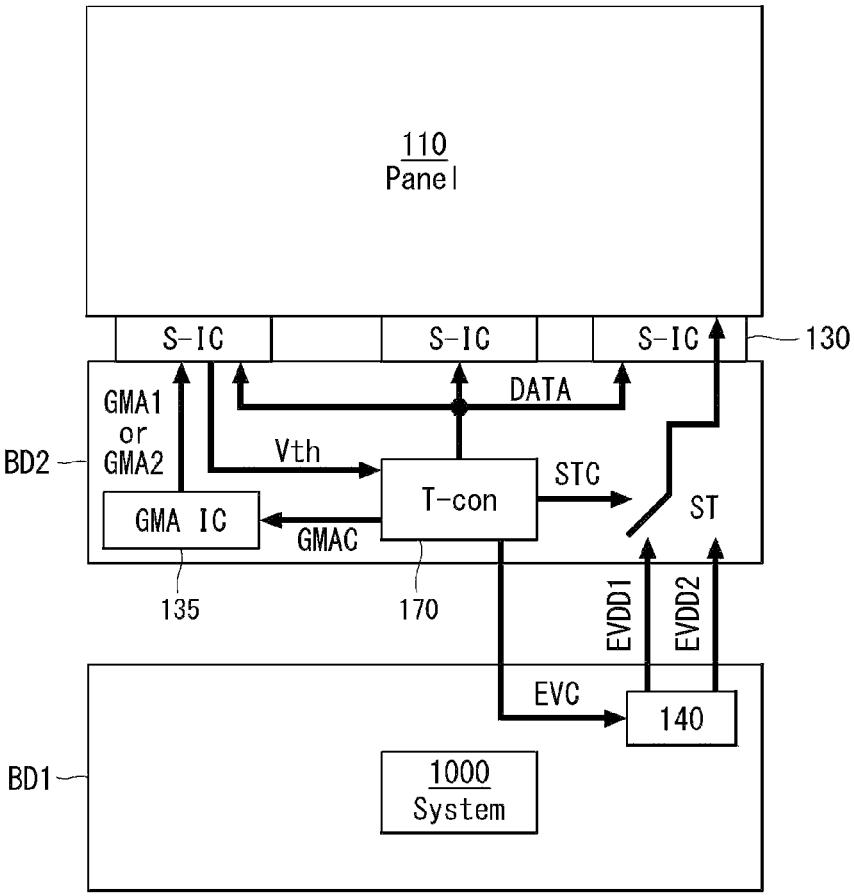
FIG. 22 shows a modular configuration in accordance with a third example of the present invention.
Figure 23:
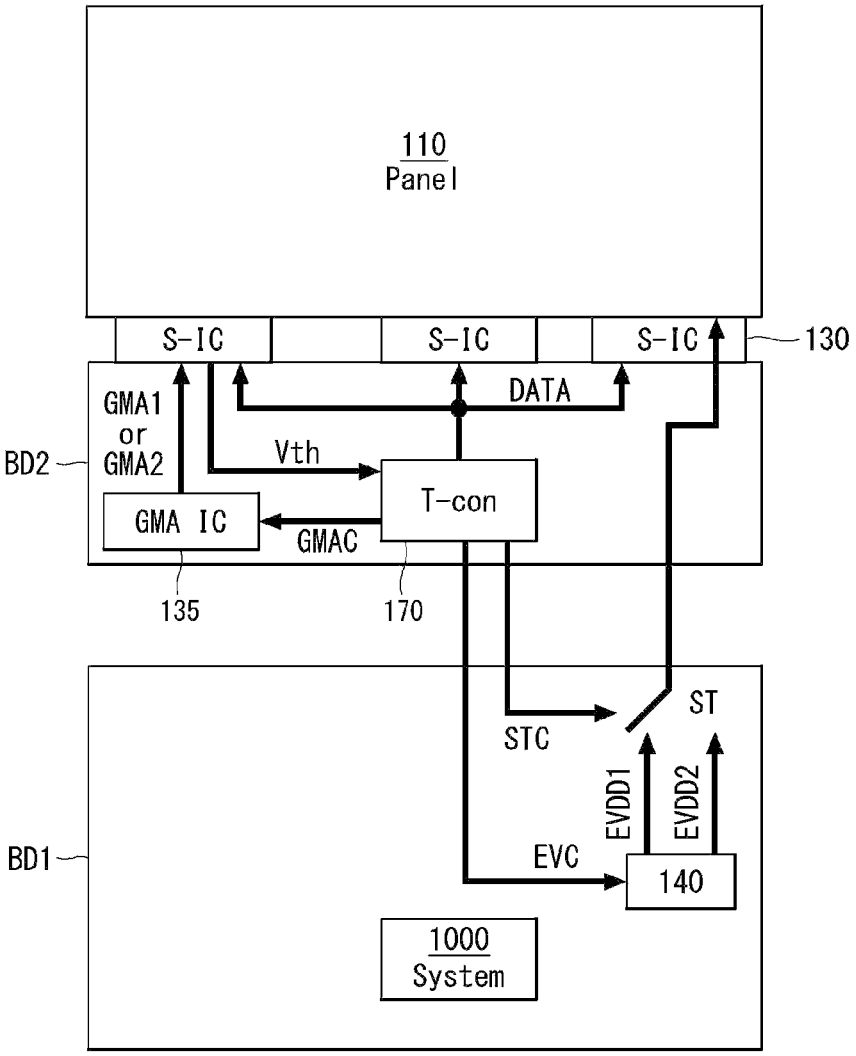
FIG. 23 shows a modular configuration in accordance with a fourth example of the present invention.

In this connection, as in a second embodiment, in order to switch the driving schemes of the drive transistor based on whether such image quality deterioration occurs for a certain image data, and switch a level of high level voltage EVDD gradually, the present OLED device may be configured as follows:

FIG. 22 shows a modular configuration in accordance with a third example of the present invention. FIG. 23 shows a modular configuration in accordance with a fourth example of the present invention.

As shown in FIG. 22 directed to the third modular configuration of the organic light-emitting display device, the organic light-emitting display device may be modularized with a first circuit board BD1, a second circuit board BD2 and a display panel 110. The first circuit board BD1 may have the host system 1000 and power supply 140 disposed thereon. The second circuit board BD2 may have the timing controller 170, the gamma module 135, and a voltage switching circuit ST disposed thereon. The voltage switching circuit ST may be disposed inside or outside the power supply 140. The gamma module 135 also performs the same functions or operations as those shown in the first example or the second example. However, since this is not principal features of the second embodiment, the descriptions thereof will be discussed with reference to the portion of the first example or the second example of the present invention.

As shown in FIG. 23 directed to the fourth modular configuration of the organic light-emitting display device, the organic light-emitting display device may be modularized with the first circuit board BD1, the second circuit board BD2 and the display panel 110. The first circuit board BD1 may have the host system 1000, power supply 140 and voltage switching circuit ST disposed thereon. The second circuit board BD2 may have the timing controller 170 and the gamma module 135 disposed thereon. The voltage switching circuit ST may be disposed inside or outside the power supply 140. However, since this is not principal features of the second embodiment, the descriptions thereof will be discussed with reference to the portion of the first example or the second example of the present invention.

The timing controller 170 may be configured to output a switch control signal STC to enable selective supply between the first high level voltage EVDD1 and second high level voltage EVDD2 from the power supply 140 disposed on the first circuit board BD1. In one example, the first high level voltage EVDD1 (saturation region drive voltage) may be higher than the second high level voltage EVDD2 (linear region drive voltage).

The timing controller 170 may be configured to generate a first switch control signal at the same time when the first drive control signal is generated by the non-linear driver disposed therein, wherein the first drive control signal enables the driving for the drive transistor using the saturation region, that is, the non-linear region.

When the timing controller 170 has outputted the first drive control signal and first switch control signal, the voltage switching circuit ST may be configured to operate such that the first high level voltage EVDD1 from the power supply 140 is supplied to the display panel 110. In this way, the display panel 110 may operate based on an operation condition of the saturation region.

The timing controller 170 may be configured to generate a second switch control signal at the same time when the second drive control signal is generated by the linear driver disposed therein, wherein the second drive control signal enables the driving for the drive transistor using the linear region, that is, the changed region.

Further, the timing controller 170 monitors or senses the deterioration characteristic of the drive transistor, for example, Vth continuously, and generates a power variable signal EVC to increase a level of the high level voltage gradually based on the deterioration characteristic of the drive transistor, for example, Vth. At this time, the timing controller 170 performs compensation operations to avoid an increase in a data voltage VDATA and gradually increase a level of the high level voltage EVDD, when the deterioration characteristic of the drive transistor, for example, Vth deviates from the reference range (the reference threshold voltage) set inside the timing controller 170.

When the timing controller 170 has outputted the second drive control signal and second switch control signal, the voltage switching circuit ST may be configured to operate such that the second high level voltage EVDD2 from the power supply 140 is supplied to the display panel 110. In this way, the display panel 110 may operate based on an operation condition of the linear region. When the timing controller 170 has outputted the power variable signal EVC, the power supply 140 changes a level of the second high level voltage EVDD2 based on the compensation operations by the timing controller 170 and outputs the level.

The present invention may reduce power consumption by a display device via the high level voltage change based on the selective driving of the drive transistor in the sub-pixel in the saturation and the linear regions. Further, the present invention may suppress deterioration in the display image quality caused by a change in the driving scheme by taking into account the presence or absence of an anticipated image quality deterioration occurrence in selectively driving the drive transistor in the sub-pixel in the saturation and the linear regions. Furthermore, the present invention may delay deterioration in the drive transistor by selectively driving the drive transistor in the sub-pixel in the saturation and the linear regions.

It will be apparent to those skilled in the art that various modifications and variations can be made in the organic light-emitting display device and the method for driving the same as disclosed herein without departing from the spirit or scope of the invention. Thus, it is intended that the present invention cover the modifications and variations of the disclosed example embodiments provided they come within the scope of the appended claims and their equivalents.

What is claimed is:

1. A display device, comprising:

a display panel including at least one data line, at least one gate line, and a sub-pixel connected to the data line and the gate line, the sub-pixel including a drive transistor;

a timing controller configured to provide a data signal and a data control signal based on an input image data and one or more timing control signals;

a data driver configured to provide a data voltage to the data line based on the data signal and the data control signal;

a power supply configured to provide a first high level voltage and a second high level voltage different from the first high level voltage; and a selective driver configured to control, based on the data signal, a selection between the first high level voltage and the second high level voltage to be supplied to a drain of the drive transistor.

2. The display device of claim 1, wherein the first high level voltage is higher than the data voltage, and the second high level voltage is lower than the data voltage.

3. The display device of claim 1, wherein the sub-pixel further includes an organic light-emission diode (OLED) connected in series with the drive transistor, the OLED being connected to a source of the drive transistor, and the drive transistor is configured to generate a current for driving the OLED.

4. The display device of claim 3, wherein:

when the drive transistor is driven in a linear region of a current-voltage curve, the selective driver is configured to cause the first high level voltage to be supplied to the drain of the drive transistor, and when the drive transistor is driven in a saturation region of the current-voltage curve, the selective driver is configured to cause the second high level voltage to be supplied to the drain of the drive transistor.

5. The display device of claim 1, wherein the selective driver includes:

a non-linear driver configured to provide a first drive control signal to enable a first driving scheme in which the drive transistor is configured to be driven in a saturation region of a current-voltage curve;

a linear driver configured to provide a second drive control signal to enable a second driving scheme in which the drive transistor is configured to be driven in a linear region of the current-voltage curve; and a gamma change driver configured to output a gamma change signal indicating a gamma change point based on a change in a driving scheme between the first driving scheme and the second driving scheme.

6. The display device of claim 5, further comprising:

a gamma circuit configured to selectively provide a first gamma voltage on a first gamma curve or a second gamma voltage on a second gamma curve to the data driver based on the gamma change signal, wherein the data driver is configured to provide the data voltage to the data line based on the first gamma voltage or the second gamma voltage selectively provided by the gamma circuit.

7. The display device of claim 6, wherein the second high level voltage is varied gradually in response to changes in the threshold voltage of the drive transistor.

8. The display device of claim 6, further comprising a timing controller configured to monitor the threshold voltage of the drive transistor, to generate a power variable signal to increase a level of the second high level voltage gradually in response to changes in the threshold voltage of the drive transistor, and to deliver the power variable signal to the power supply.

9. The display device of claim 5, further comprising:

a compensation circuit configured to provide a compensation signal to the display panel to compensate for a characteristic variation in the display panel based one or more of the data signal, a change in the driving scheme, and a change in the gamma change point.

10. The display device of claim 9, wherein one or both of the selective driver and the compensation circuit are included in the timing controller.

11. A display device, comprising:

a display panel having at least one data line, at least one gate line, and a sub-pixel connected to the data line and the gate line, the sub-pixel including a drive transistor;

a first circuit board including:

a host system configured to provide an input image data and one or more timing signals, and a power supply configured to provide a first high level voltage and a second high level voltage different from the first high level voltage;

a second circuit board including:

a timing controller configured to provide a data signal and a data control signal based on the input image data and the one or more timing control signals, and a selective driver configured to control, based on the input image data, a selection between the first high level voltage and the second high level voltage to be supplied to a drain of the drive transistor; and a data driver configured to provide a data voltage to the data line based on the data signal and the data control signal.

12. The display device of claim 11, wherein the sub-pixel further includes an organic light-emission diode (OLED) connected in series with the drive transistor, the OLED being connected to a source of the drive transistor, and the drive transistor is configured to generate a current for driving the OLED.

13. The display device of claim 11, wherein the selective driver includes:

a non-linear driver configured to provide a first drive control signal to enable a first driving scheme in which the drive transistor is configured to be to be driven in a saturation region of a current-voltage curve;

a linear driver configured to provide a second drive control signal to enable a second driving scheme in which the drive transistor is configured to be driven in a linear region of the current-voltage curve; and a gamma change driver configured to output a gamma change signal indicating a gamma change point based on a change in a driving scheme between the first driving scheme and the second driving scheme.

14. The display device of claim 13, wherein the second circuit board further includes:

a gamma circuit configured to selectively provide a first gamma voltage on a first gamma curve or a second gamma voltage on a second gamma curve to the data driver based on the gamma change signal, wherein the data driver is configured to provide the data voltage to the data line based on the first gamma voltage or the second gamma voltage selectively provided by the gamma circuit.

15. The display device of claim 13, further comprising:

a compensation circuit configured to provide a compensation signal to compensate for a characteristic variation in the display panel based one or more of the data signal, a change in the driving scheme, and a change in the gamma change point, wherein one or both of the selective driver and the compensation circuit are included in the timing controller.

16. A method of driving a display device comprising a display panel having at least one data line, at least one gate line, and a sub-pixel at an intersection of the data line and the gate line, the sub-pixel including a drive transistor, the method comprising:

receiving an input image data and one or more timing signals from a timing controller;

generating a data signal and a data control signal based on the input image data and the one or more timing signals;

providing a data voltage to the data line based on the data signal and the data control signal; and selectively supplying, based on the data signal, a first high level voltage higher than the data voltage and a second high level voltage lower than the data voltage to a drain of the drive transistor, the first high level voltage and the second high level voltage being provided by a power supply.

17. The method of claim 16, wherein the selectively supplying includes:

selectively generating a first drive control signal to enable a first driving scheme or a second drive control signal to enable a second driving scheme, wherein the drive transistor is configured to be driven in a saturation region of a current-voltage curve in the first driving scheme and in a linear region of the current-voltage curve in the second driving scheme.

18. The method of claim 17, wherein:

the selectively supplying further includes:

providing a gamma change signal indicating a gamma change point based on a change in a driving scheme between the first driving scheme and the second driving scheme, and selectively determining a first gamma voltage on a first gamma curve or a second gamma voltage on a second gamma curve based on the gamma change signal; and the providing of the data voltage includes determining the data voltage based on the first gamma voltage or a second gamma voltage that is selectively determined.

19. The method of claim 18, further comprising:

providing a compensation signal to the display panel to compensate for a characteristic variation in the display panel based one or more of the data signal, a change in the driving scheme, and a change in the gamma change point.

20. The method of claim 17, wherein the second high level voltage is varied gradually in response to changes in the threshold voltage of the drive transistor when the drive transistor is driven in the linear region.

* * * * *